US007665259B2

(12) United States Patent
Yoon et al.

(10) Patent No.: US 7,665,259 B2
(45) Date of Patent: Feb. 23, 2010

(54) BUILT-UP RECTANGULAR STEEL COLUMN FOR FILLING CONCRETE THEREIN HAVING L-SHAPED MEMBERS AND STEEL PLATES WITH CURVING PROJECTIONS AND CONVEX EMBOSSED PORTIONS

(75) Inventors: Young-Ho Yoon, Seoul (KR); Sang-Yeon Kim, Sungnam-si (KR); Su-Jin Lee, Sungnam-si (KR); Hyung-Geun Kim, Seoul (KR); Chang-Shin Lee, Hwaseong-si (KR); Soon-Woo Nam, Goyang-si (KR); Seok-Tae Kang, Incheon (KR); Chang-Nam Lee, Seoul (KR); Sung-Bae Kim, Seoul (KR)

(73) Assignees: Korea National Housing Corporation, Bundang-Gu,Sungnami-Si, Gyonggi-Do (KR); SH Corporation, Gangnam-Gu, Seoul (KR); Myong HWA Engineering Co., Ltd., Gangnam-Gu, Seoul (KR); Sen Structural Engineers Co., Ltd., Yeongdeungpo-Gu, Seoul (KR)

( * ) Notice: Subject to any disclaimer, the term of this patent is extended or adjusted under 35 U.S.C. 154(b) by 307 days.

(21) Appl. No.: 11/295,296

(22) Filed: Dec. 6, 2005

(65) Prior Publication Data

US 2006/0117704 A1 Jun. 8, 2006

(30) Foreign Application Priority Data

Dec. 6, 2004 (KR) ..... 10-2004-0102058
Aug. 22, 2005 (KR) ..... 10-2005-0076625

(51) Int. Cl.
*E04C 3/34* (2006.01)
*E04B 1/18* (2006.01)

(52) U.S. Cl. ..... 52/423; 52/252; 52/834

(58) Field of Classification Search ..... 249/48, 249/49, 50, 51; 52/423, 433, 439, 440, 443, 52/260, 834, 846, 843, 836, 251, 252, FOR. 106, 52/FOR. 109, FOR. 115, FOR. 134, FOR. 142, 52/FOR. 154, FOR. 159, FOR. 161, FOR. 162, 52/253

See application file for complete search history.

(56) References Cited

U.S. PATENT DOCUMENTS 607,258 A * 7/1898 Matthews ..... 52/255
863,555 A * 8/1907 Poole ..... 52/423

(Continued)

*Primary Examiner*—Gay Ann Spahn
(74) *Attorney, Agent, or Firm*—John K. Park; Park Law Firm

(57) ABSTRACT

Disclosed herein is a built-up type box-shaped steel column for filling concrete therein, that can be formed easily and economically in a built-up scheme by using ]-beams and steel plates, and a method for manufacturing the same that includes bonding a steel plate at the inner surface of a ]-shapes during a process of making a built-up type box-shaped steel column, thereby having a good resistance against a lateral pressure of concrete filled in the steel column and preventing the bonded portion from being exposed to the outside to provide a better outer appearance. The built-up type box-shaped steel column for filling concrete therein, includes: a ]-shapes disposed at each of the four corners of a box-shaped steel column to be formed; and a steel plate disposed between the ]-shapes adjacent to each other for connecting the ]-shapes with each other.

3 Claims, 6 Drawing Sheets

U.S. PATENT DOCUMENTS 1,033,797 A * 7/1912 Hartman ..... 52/252
1,052,696 A * 2/1913 Sloan ..... 52/295
1,099,953 A * 6/1914 Waite ..... 52/236.5
1,114,946 A * 10/1914 Venable ..... 249/49
1,135,721 A * 4/1915 Robinson ..... 264/34
1,141,160 A * 6/1915 Waite ..... 52/252
1,599,035 A * 9/1926 Baumberger ..... 249/48
1,718,693 A * 6/1929 Kahn ..... 52/651.07
1,757,664 A * 5/1930 Gohmann ..... 52/282.3
2,833,524 A * 5/1958 Wolf ..... 165/56
2,873,503 A * 2/1959 Davis ..... 249/48
3,519,242 A * 7/1970 Harkins ..... 249/48
3,676,967 A * 7/1972 Frati ..... 52/220.2
3,722,159 A * 3/1973 Kessler ..... 52/252
3,793,793 A * 2/1974 Dobbins ..... 52/220.3
3,812,636 A * 5/1974 Albrecht et al. ..... 52/334
3,857,540 A * 12/1974 Ecker ..... 249/48
3,938,294 A * 2/1976 Gaburri ..... 52/742.14
3,945,601 A * 3/1976 Rowley ..... 249/48
4,071,996 A * 2/1978 Muto et al. ..... 52/745.21
4,125,973 A * 11/1978 Lendrihas ..... 249/188
4,125,977 A * 11/1978 Michlovic ..... 52/220.4
4,358,084 A * 11/1982 Bowman ..... 249/82
4,604,250 A * 8/1986 Ecker ..... 264/35
4,962,622 A * 10/1990 Albrecht et al. ..... 52/630
5,044,136 A * 9/1991 Liu ..... 52/252
5,177,918 A * 1/1993 Chang ..... 52/252
5,437,698 A * 8/1995 Furukawa ..... 47/65.9
5,491,946 A * 2/1996 Landis et al. ..... 52/336
6,295,770 B1 * 10/2001 Sheu et al. ..... 52/167.1
6,655,103 B1 * 12/2003 Lueghamer ..... 52/598
2004/0045241 A1 * 3/2004 Guillebeau ..... 52/378
2004/0194420 A1 * 10/2004 Venegas, Jr. ..... 52/736.3
2004/0217254 A1 * 11/2004 Myers et al. ..... 249/33
2005/0097854 A1 * 5/2005 Tu ..... 52/720.1
2005/0229531 A1 * 10/2005 Green et al. ..... 52/736.1
2007/0022705 A1 * 2/2007 Rouse ..... 52/720.1

* cited by examiner

Fig. 8
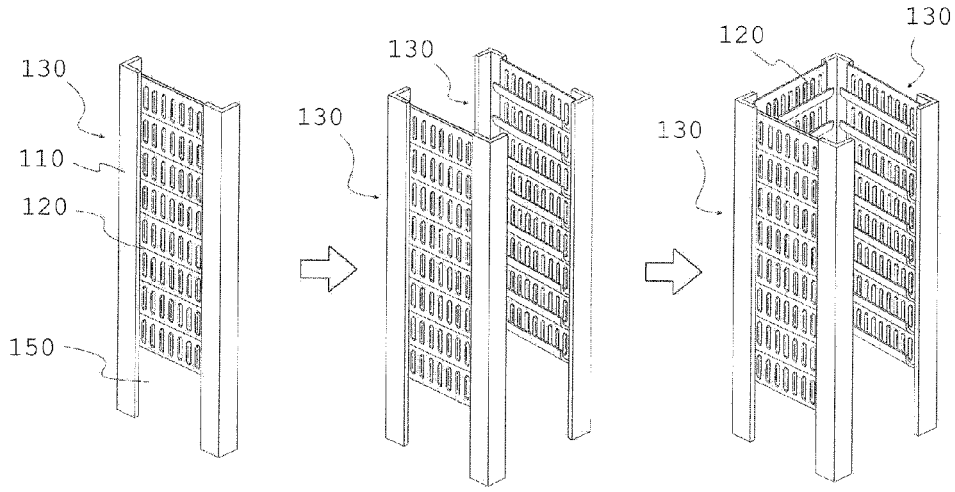
Fig. 8(a) Fig. 8(b) Fig. 8(c)
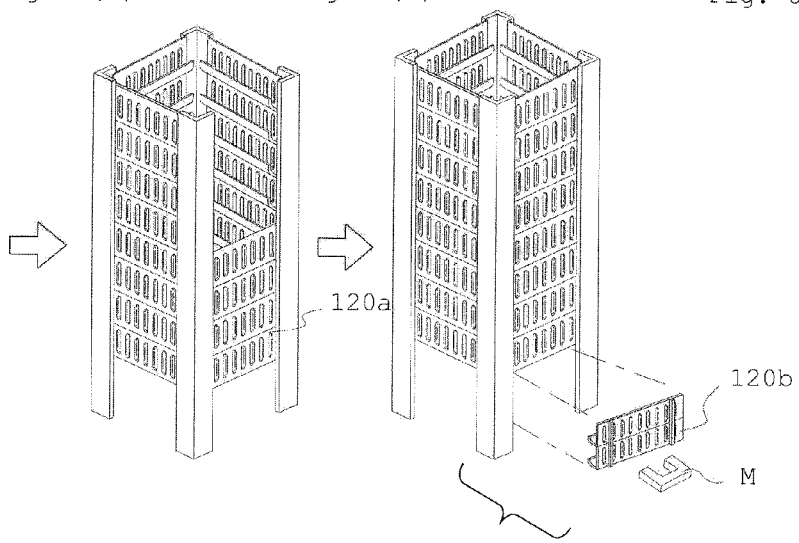
Fig. 8(d) Fig. 8(e)

BUILT-UP RECTANGULAR STEEL COLUMN FOR FILLING CONCRETE THEREIN HAVING L-SHAPED MEMBERS AND STEEL PLATES WITH CURVING PROJECTIONS AND CONVEX EMBOSSED PORTIONS

CLAIMING FOREIGN PRIORITY

The applicant claims and requests a foreign priority, through the Paris Convention for the Protection of Industrial Property, based on patent applications filed in the Republic of Korea (South Korea) with the filing date of Dec. 6, 2004 with the patent application number 10-2004-0102058 and with the filing date of Aug. 22, 2005 with the patent application number 10-2005-0076625 by the applicant, the contents of which are incorporated by reference into this disclosure as if fully set forth herein.

BACKGROUND OF THE INVENTION

1. Field of the Invention

The present invention relates to a built-up type box-shaped steel column for filling concrete therein and a method for manufacturing the same, and more particularly, to a built-up type box-shaped steel column for filling concrete therein, that can be formed easily and economically in a built-up scheme by using ]-shapes and steel plates, and a method for manufacturing the same that includes bonding a steel plate at the inner surface of ]-shapes during a process of making a built-up type box-shaped steel column, thereby having good resistance against a lateral pressure of concrete filled in the steel column and preventing a bonded portion from being exposed to the outside thus to provide a better outer appearance.

2. Background of the Related Art

Generally, a CFT (Concrete Filled Tube) structure is formed by filling concrete at the inside of tubular steel columns, thereby having good advantages in the stiffness, yield strength, the capability of elongation, fire resistance, and construction thereof.

Typically, most of the tubular steel columns that are employed in the CFT structure are formed integrally or are finished with the steel plate assembled therewith. Such the tubular steel columns are customized and manufactured in large-sized factories where specific manufacturing equipment is prepared, which causes the production costs to be inevitably high. This also creates another problem in that the applicability of the CFT structure is somewhat restricted. Although the CFT structure has actually the advantages of the structural stability and construction capability thereof, it is generally adopted only for the construction of the low floors of high large-scaled buildings.

SUMMARY OF THE INVENTION

Accordingly, the present invention has been made in view of the above-mentioned problems occurring in the prior art, and it is an object of the present invention to provide a built-up type box-shaped steel column for filling concrete therein, that can be formed easily and economically in a built-up scheme by using ]-shapes and steel plates.

It is another object of the present invention to provide a method for manufacturing a built-up type box-shaped steel column for filling concrete therein, that includes bonding a steel plate at the inner surface of ]-shapes during a process of making a built-up type box-shaped steel column, thereby having good resistance against a lateral pressure of concrete filled in the steel column and preventing a bonded portion from being exposed to the outside thus to provide a better outer appearance.

It is still another object of the present invention to provide a built-up type box-shaped steel column for filling concrete therein and a method for manufacturing the same, that can be formed easily at a step of constructing the steel column at a construction site, thereby finishing the manufacturing of the steel column filled with concrete.

To accomplish the above objects, according to one aspect of the present invention, there is provided a built-up type box-shaped steel column for filling concrete therein comprising: a ]-shapes disposed at each of the four corners of the box-shaped steel column; and a steel plate disposed between the ]-shapes adjacent to each other for connecting the ]-shapes with each other.

According to another aspect of the present invention, there is also provided a method for manufacturing a built-up type box-shaped steel column for filling concrete therein, the method comprising the steps: (a) arranging two ]-shapes spaced apart from each other, disposing a steel plate between the two ]-shapes in such a manner as to abut against the inner surface of each of the two ]-shapes, and bonding the steel plate to the two ]-shapes on the inside thereof, to thereby form a first surface of the box-shaped steel column; (b) arranging two first built-up members (each built-up member made by bonding the steel plate between the two ]-shapes) made at the step (a) in such a manner as to be spaced apart from each other in a facing relation with each other, to thereby form a second surface of the box-shaped steel column; (c) inserting the steel plate between the two first built-up members spaced apart from each other in such a manner as to abut against the inner surfaces of the two ]-shapes of each of the two first built-up members, and then bonding the steel plate to the two ]-shapes on the inside thereof, to thereby form a third surface of the box-shaped steel column; and (d) closing an opened one surface of the steel column with a steel plate in the same manner as the step (c), to thereby form a fourth surface of the box-shaped steel column.

BRIEF DESCRIPTION OF THE DRAWINGS

The above and other objects, features and advantages of the present invention will be apparent from the following detailed description of the preferred embodiments of the invention in conjunction with the accompanying drawings, in which:

FIGS. 8*a* to 8*e* are views showing the manufacturing steps of the built-up type box-shaped steel column for filling concrete therein of FIG. 1;

DETAILED DESCRIPTION OF THE PREFERRED EMBODIMENT

Reference will now be made in detail to the preferred embodiments of the present invention, examples of which are illustrated in the accompanying drawings.

Figure 1:
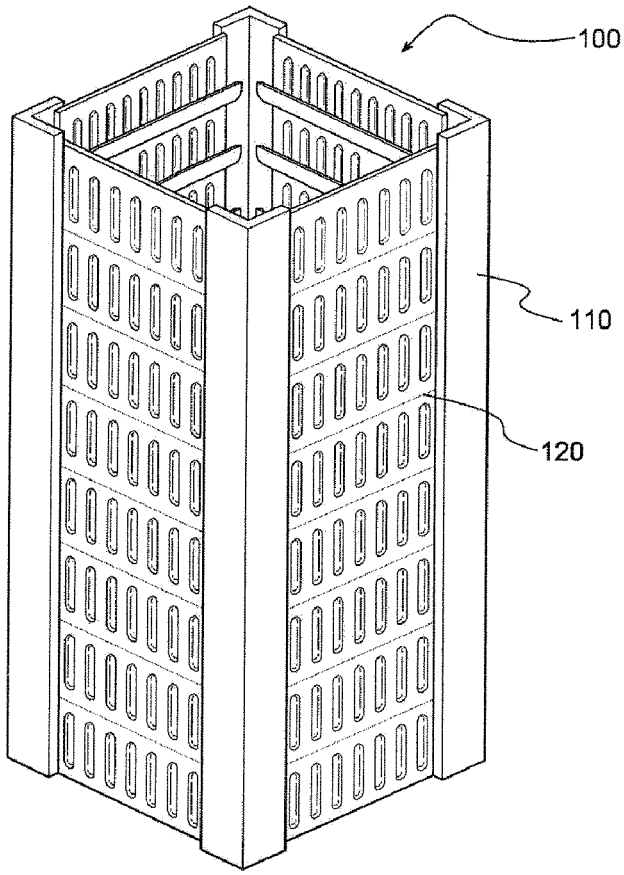
FIGS. 1 to 4 are views showing a built-up type box-shaped steel column for filling concrete therein according to preferred embodiments of the present invention.

FIG. 1 is a perspective view showing a built-up type box-shaped steel column for filling concrete therein according to a first embodiment of the present invention. According to a feature of this invention, as shown, a built-up type box-shaped steel column 100 for filling concrete therein includes: a ]-shapes 110 disposed at each of the four corners of a box-shaped steel column 100; and a steel plate 120 disposed between the ]-shapes adjacent to each other for connecting the ]-shapes 110 with each other. According to the present invention, the ]-shapes 110 and the steel plate 120 are made of different materials from each other such that the ]-shapes 110 is disposed at each corner to which yield strength is structurally largest and the steel plate 120 having a relatively thin thickness is provided on the entire surfaces except the corners, which enables a structural yield strength to be maximized at an expense of a small quantity of steel consumption.

Figure 2:
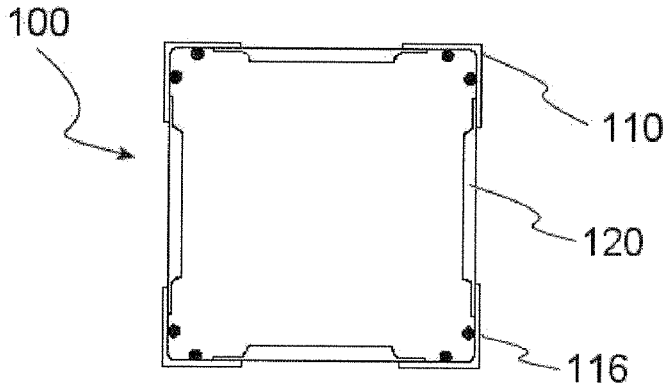

FIG. 2 is a sectional view showing a built-up type box-shaped steel column 100 for filling concrete therein according to a second embodiment of the present invention, wherein the whole construction is the same as in FIG. 1, except that steel bars 116 are bonded at the inner surfaces of the ]-shapes 110 by means of welding. The steel bars 116 are employed when the section is insufficient just with the ]-shapes 110.

Figure 3:
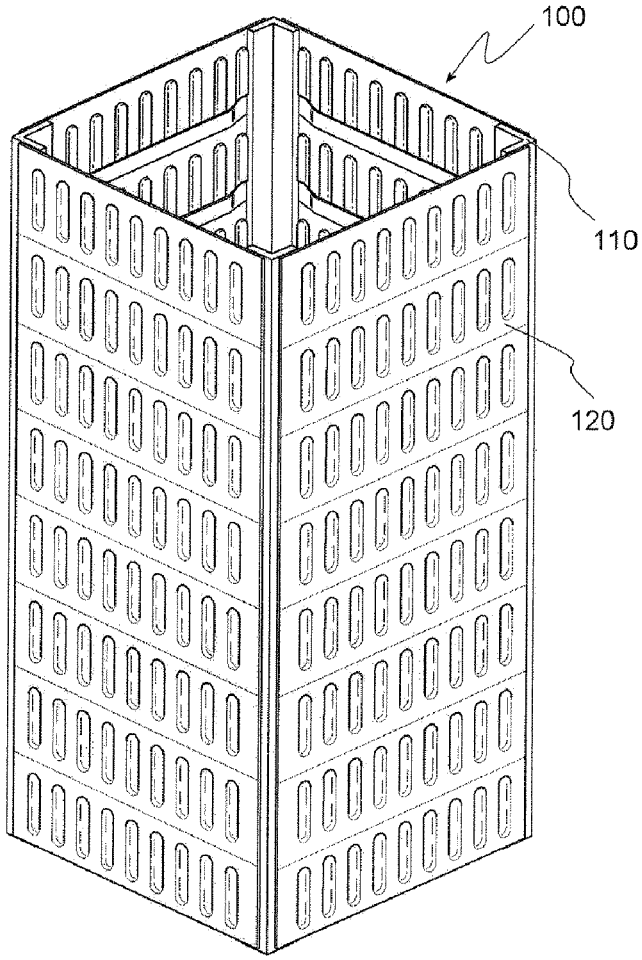

FIG. 3 is a perspective view showing a built-up type box-shaped steel column for filling concrete therein according to a third embodiment of the present invention, wherein the steel plate 120 is bonded to the outer face of the ]-shapes 110. However, the steel column 100 of this invention as shown in FIG. 1 where the steel plate 120 is bonded to the inner surface of the ]-shapes 110 is more advantageous than that as shown in FIG. 3 in that the steel plate 120 is not deviated from the ]-shapes 110 with ease even though a relatively severe lateral pressure upon the filling of concrete is acted or the bonding state is not good. Furthermore, since no tension is formed and only shearing force is formed at the bonded portion of the steel plate 120 at the inner surface of the ]-shapes 110, there is no possibility that the steel plate 120 is deviated from the bonded portion thereof, and preferably, frictional resistance is generated at a surface where the lateral pressure of concrete depressing the steel plate 120 is met with the ]-shapes 110, which makes the bonding force between the ]-shapes 110 and the steel plate 120 stronger. Additionally, when the steel plate 120 is bonded to the inner surface of the ]-shapes 110, both end portions of the steel plate 120 are bonded to the inner surfaces of the ]-shapes 110 in such a manner as to be accommodated in the box-shaped steel column 100, such that the ]-shapes 110 serves as a molding member for protecting the four corners of the box-shaped steel column 100, which makes an outer appearance of the steel column 100 look good.

Figure 4:
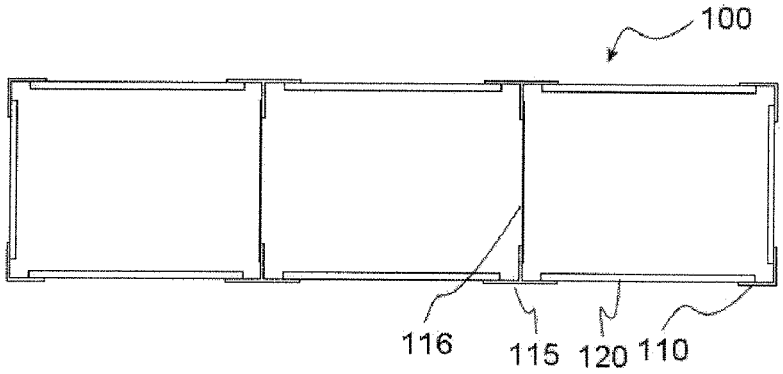

FIG. 4 is a sectional view showing a built-up type box-shaped steel column 100 for filling concrete therein according to a fourth embodiment of the present invention. The fourth embodiment of the present invention is applied to a relatively large-sized steel column 100. In a case where the size of the steel column 100 becomes larger, additionally, T-shaped beams 115 are disposed spaced apart from each other between the ]-shapes 110 in such a manner as to direct webs toward the inside of the steel column, and the steel plate 120 is disposed between the ]-shapes 110 and the T-shaped beam 115, thereby completing the steel column in a given size. At this time, the steel bar 116 is bonded to the webs of the T-shaped beams 115 disposed to face each other in the long side direction thereof for the purpose of reinforcing the space defined by the T-shaped beams 115.

Figure 5:
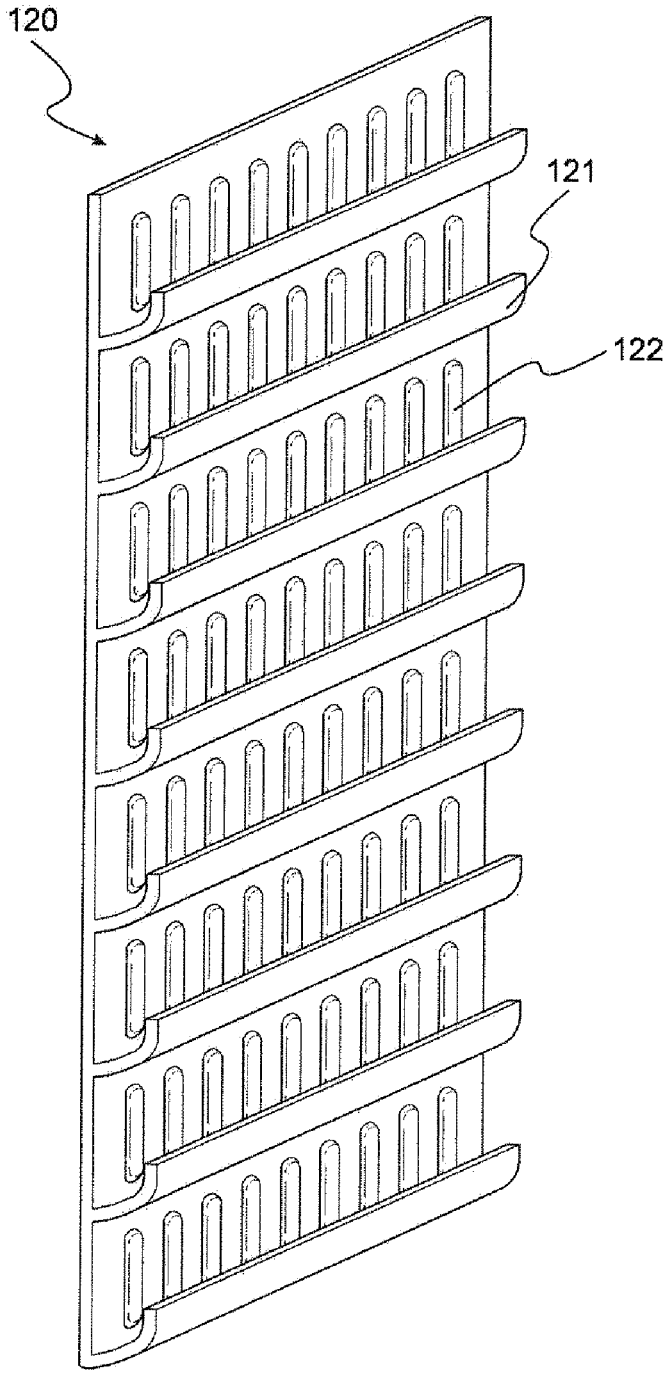
FIGS. 5 to 7 are perspective views showing various examples of the steel plate employed in the built-up type box-shaped steel column for filling concrete therein according to the preferred embodiments of the present invention.
Figure 6:
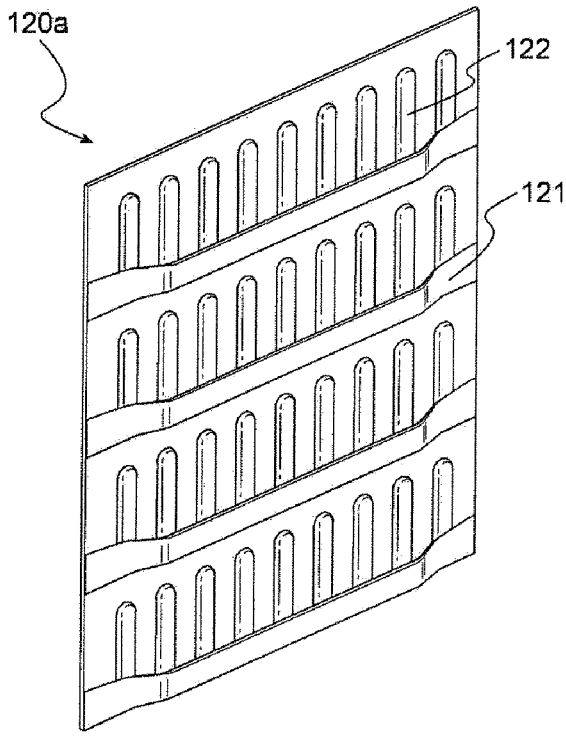
Figure 7:
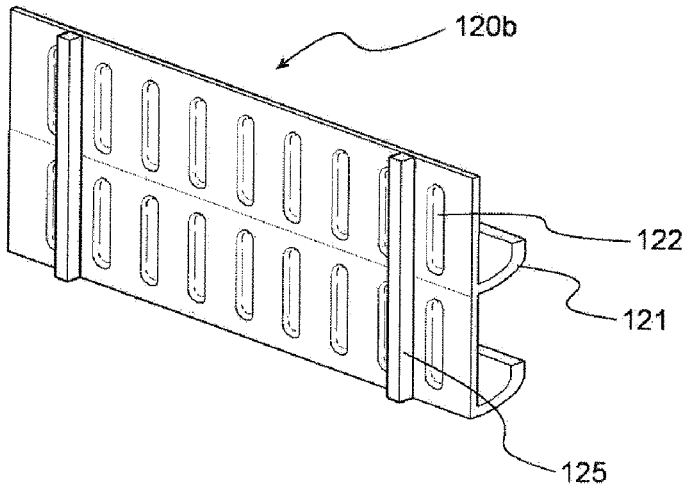

FIGS. 5 to 7 are perspective views showing various examples of the steel plate employed in the built-up type box-shaped steel column for filling concrete therein according to the preferred embodiments of the present invention. The examples of the steel plate are selected appropriately by sizes according to the manufacturing process of the box-shaped steel column of this invention. Of course, each of the steel plates has a plurality of protrusions 121 and a plurality of embossed portions 122 formed on the inner surface thereof. The plurality of protrusions 121 is formed on the inner surface of the steel plate 120 in such a manner that they are spaced apart from one another in parallel with the inner surface of the steel plate 120 and are extended upwardly at one end so as to form horizontal bands, which preferably enables the good function of the protrusion to be encouraged and also enables concrete filled in the steel column to be tight in the steel column. The formation of protrusions 121 makes section modulus and moment of inertia of the steel plate 120 increased thereby improving bending rigidity and the yield strength of elongation resistance, such that even though the steel plate is substantially thin (for example, less than 1 mm), the box-shaped steel column 100 of this invention can sufficiently endure the lateral pressure of concrete filled in the interior thereof. Also, the protrusions 121 serve as band type steels for reinforcing the concrete filled in the interior of the box-shaped steel column 100. The plurality of embossed (expanded) portions 122 that are formed convexedly on the inner surface of the steel plate 120 serve to make the rigidity of the steel plate 120 increased, in the same manner as the protrusions 121, thereby improving a resistance capability with respect to the lateral pressure of the concrete.

The protrusions 121 and the embossed portions 122 are formed easily by means of roll forming at a molding process of a hot coil. At this time, the hot coil has a thickness of 0.8 mm or more, and each of the protrusions 121 has a height of 35 mm and has a distance of 150 mm from the adjacent protrusion 121 thereto. If the box-shaped steel column is to be made with the steel plate 120 on which the protrusions 121 and the embossed portions 122 are formed by means of the roll forming, the protrusions 121 and the embossed portions 122, which are formed on the bonded portion to the ]-shapes 110 in the case where the steel plate 120 is bonded to the outer face of the ]-shapes 110, as shown in FIG. 3, should be processed as smooth surfaces, as shown in FIG. 6. Especially, as the portion processed as the smooth surfaces directly abuts against the ]-shapes 110, the smooth surface processing should be carefully conducted for the purpose of obtaining tight bonding. To avoid the inconveniences caused upon the bonding of the steel plate 120 to the outer face of the ]-shapes 110, it is desirable that the steel plate 120 is bonded to the inner surface of the ]-shapes 110. This is because the steel plate 120 on which the protrusions 121 and the embossed portions 122 are not formed directly abuts against the ]-shapes 110 at the outer surface thereof, without having any smooth surface processing. In the case where the steel plate 120 is bonded to the inner surface of the ]-shapes 110, however, both end portions of each of the protrusions 121 may be pressed if necessary such that a welded material is ensured in thickness required. Since the ]-shapes 110 is bonded to the outer surface of the steel plate 120, however, there is no problem in that the steel plate 120 is tightly bonded to the ]-shapes 110 even though the steel plate 120 is not regular on the inner surface thereof.

FIGS. 8*a* to 8*e* are views showing the manufacturing steps of the built-up type box-shaped steel column for filling concrete therein of FIG. 1. Now, an explanation of the manufacturing steps will be given in detail below.

FIG. 8*a* shows a step (a) making a first built-up member 130, thereby completing the formation of a first surface of the steel column.

First, the two ]-shapes 110 are arranged spaced apart from each other and the steel plate 120 is disposed between the two ]-shapes 110 in such a manner as to abut against the inner surface of each of the two ]-shapes. Then, the steel plate 120 is bonded to the two ]-shapes on the inside thereof, thereby completing the formation of the first surface of the box-shaped steel column.

The steel plate 120 may have a size corresponding to a height of one-floor as shown in FIG. 5, and may be used as a band type steel plate 120*a*, as shown in FIG. 6, having a size smaller than that in FIG. 5. The band type steel plate 120*a* is advantageous to spot welding to the ]-shapes 110 through a direct current method. The direct current method is made by pressing the opposite faces to the surfaces of a bonding material and a material to be bonded facing each other with positive and negative electrodes in the opposite directions to each other, thereby transmitting electricity to conduct the welding. At this time, the forces of pressing the opposite faces of the materials to be bonded to each other are offset to prevent twisting deformation from occurring such that the yield strength on the bonded portion is not damaged at all. It is therefore appreciated that the direct current method is more desirable than an indirect current method where the positive and negative electrodes are pressed on the same surfaces of the materials to be bonded to each other in the same direction as each other. However, since the direct current method requires a space where the materials to be bonded are pressed to charge the electricity thereon, it has a limitation in the distance from the end of the material to the welded point thereon. The problem of the distance limitation the direct current method has is solved by adopting the band type steel plate 120*a* (having a vertical distance of about 600 mm). That is to say, the band type steel plate 120*a* is welded to another band type steel plate 120*a* such that the plurality of band type steel plates 120*a* are bonded to one another, thereby completing the entire one surface of the box-shaped steel column 100 (see FIG. 8*d* where the bonding method of the band type steel plate 120*a* is shown). By the way, preferably, a base material has to have a given thickness upon the spot welding, but since the steel plate that is generally adopted in the present invention has a thickness between 0.8 mm and 10 mm, both end portions of each of the plurality of protrusions 121 are pressed to ensure a desired thickness. Thus, the spot welding is conducted on the pressed portions.

Figure 9:
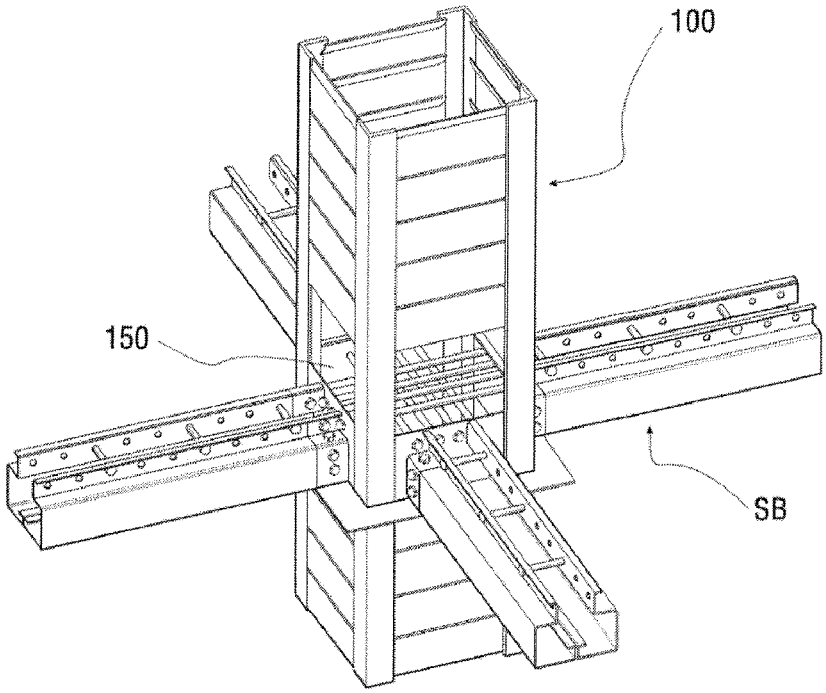
FIG. 9 is a perspective view showing the usage state of the steel column of this invention on a construction site.

More particularly, an opened space 150 where no steel plate (inclusive of the band type steel plate) is formed may be provided at a portion of the box-shaped steel column 100, which is prepared as a space used when steel beams SB are bonded to the box-shaped steel column 100 by means of bolts (see FIG. 9). In other words, in a case where the steel beams SB are bonded to the box-shaped steel column 100 by means of bolts in a panel zone where the steel column 100 is bonded to the steel beams SB, as shown in FIG. 9, a given space should be prepared such that the bolts are inserted and nuts are fastened for the coupling. To arrange the space, the steel plate 120 is not provided in the panel zone, and the opened space 150 is formed, instead. Furthermore, the opened space 150 may be used as a space for filling concrete in the box-shaped steel column 100.

FIG. 8*b* shows a step (b) arranging the first built-up member 130, thereby completing the formation of a second surface of the steel column.

The two first built-up members 130 (each built-up member made by bonding the steel plate 120 between the two ]-shapes 110) made at the step (a) are arranged spaced apart from each other in a facing relation with each other, thereby completing the formation of the second surface of the box-shaped steel column 100.

FIG. 8*c* shows a step (c) bonding the steel plate 120 between the two first built-up members 130, thereby completing the formation of a third surface of the steel column.

The steel plate 120 is inserted between the two first built-up members spaced apart from each other in such a manner as to abut against the inner surfaces of the two ]-shapes of each of the two first built-up members and bonding the steel plate to the two ]-shapes on the inside thereof, thereby completing the formation of the third surface of the box-shaped steel column 100. This step is carried out for closing one surface (that is, the third surface) in a state where the two surfaces of the steel column have opened. In this case, since a fourth surface of the steel column is still opened, the inside bonding of the steel plate 120 is easily conducted, without any trouble. Of course, the band type steel plate 120*a* can be used at this step, and in the same manner as mentioned above, the steel plate is not provided in the panel zone.

FIG. 8*d* shows a step (d) completing the formation of the box-shaped steel column, thereby completing the formation of a fourth surface of the steel column.

The opened one surface (that is, the fourth surface) of the steel column is closed with the steel plate 120 in the same manner as the step (c). In this case, since the step (d) is conducted in a state where the three surfaces have already closed, the inside bonding of the steel plate 120 of the fourth surface of the steel column is conducted in somewhat hard way. At this time, especially, the band type steel plate 120*a* is adopted preferably for covering the fourth surface of the steel column. In the same manner as mentioned above, at this step the steel plate is not provided in the panel zone.

The steel column that is made through the steps (a) to (d) may be carried to the construction site for installation there, and it may be formed through the steps (a) to (d) just on the construction site.

FIG. 8*e* shows a step (e) bonding a band type steel plate 120*b* for the opened space 150 between the two first built-up members 130, thereby completing the closing of the opened space of the steel column.

In the case where the opened space 150 is formed such that the steel plate 120 is not provided in the panel zone at the steps (a) through (d), the opened space 150 should be closed after completing the first to fourth surfaces of the steel column. That is to say, in the case where the steps (a) to (d) are made by forming the opened space 150 in the panel zone for bonding the steel column to the steel beams SB, the opened space 150 has to be closed for filling concrete into the steel column 100 after completing the bonding between the steel column 100 and the steel beams SB (see FIG. 9).

At the step (e) the band type steel plate 120*b* for the opened space 150 is prepared and inserted between the adjacent ]-shapes 110 to each other in such a manner as to abut against the inner surfaces of the ]-shapes 110. Then, the band type steel plate 120*b* for the opened space 150 is bonded to the ]-shapes 110 on the outside thereof. Since this step is conducted to completely close the steel column 100, it is somewhat hard to bond the band type steel plate 120*b* on the inside thereof, such that at the state where the band type steel plate 120*b* is disposed at the inner surfaces of the ]-shapes 110, it is bonded thereto on the outside thereof. At this time, a magnetic handle grip M serves to maintain the state where the band type steel plate 120*b* for the opened space 150 is disposed at the inner surfaces of the ]-shapes 110 such that the bonding can be conducted well on the outside thereof.

The band type steel plate 120*b* for the opened space 150 may be used together with bonded steel bars 125 formed at outer both ends thereof, and each of the bonded steel bars 126 serves to reinforce the bonded portion between the band type steel plate 120*b* for the opened space 150 and the ]-shapes 110, suppressing the movement in the left and right directions of the band type steel plate 120*b* for the opened space 150. In this case, the bonded steel bar 125 is bonded to the end portion of the ]-shapes 110 by means of welding, thereby completing the bonding the band type steel plate 120*b* for the opened space 150 to the steel column 100.

Figure 10:
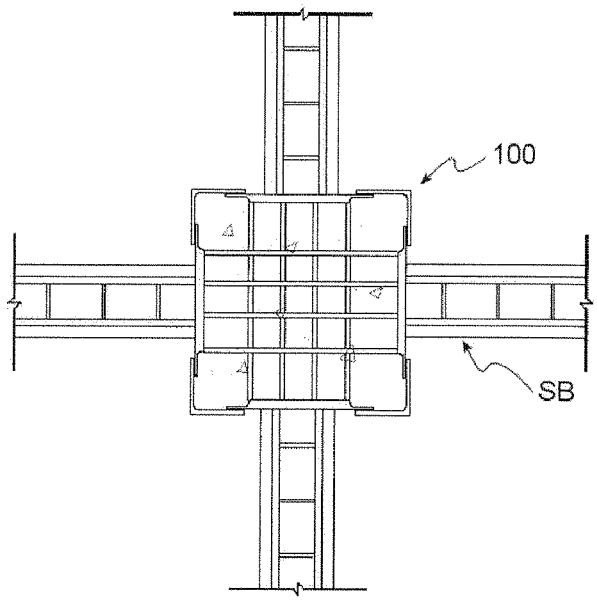
FIG. 10 is a sectional view of FIG. 9.

The box-shaped steel column that is built up through the steps as mentioned above is filled with concrete, thereby having a CFT structure. More preferably, if the box-shaped steel column of this invention is applied together with a steel plate molding beam (made by molding a steel plate to make a closed shape and by filling concrete in the closed space), as shown in FIGS. 9 and 10, both the beam and the column become a concrete filled structure.

As described above, according to the preferred embodiments of the present invention, there is provided a built-up type box-shaped steel column for filling concrete therein that can be formed easily and economically by using ]-beams and steel plates, and a method for manufacturing the same that includes bonding a steel plate at the inner surface of ]-shapes during a process of making a built-up type box-shaped steel column, thereby having good resistance against a lateral pressure of concrete filled in the steel column and preventing a bonded portion from being exposed to the outside thus to provide a better outer appearance.

Preferably, a typical steel column that is made of steel on the entire surfaces thereof is adopted for the low floor portions where large loads are applied in multi-floor buildings having a CFT structure, whereas the built-up type box-shaped steel column for filling concrete therein according to the present invention is adopted for the high floor portions where loads are relatively decreased.

While the present invention has been described with reference to the particular illustrative embodiments, it is not to be restricted by the embodiments but only by the appended claims, and therefore, it is to be understood that other modifications and variations may be made without departing from the substance and scope of the present invention, as those skilled in the art will readily understand. Such alternate modifications and variations are within the scope of the present invention which is intended to be limited only by the appended claims and equivalents thereof.

What is claimed is:

1. A built-up rectangular steel column for concrete-filled tube structure, comprising:

four L-shaped steel frames disposed at each of four corners of a rectangular cross section of the rectangular steel column to form right angles of the rectangle; and steel plates disposed between the L-shaped steel frames adjacent to each other to form side planes of the rectangular steel column, wherein each of the steel plates is bonded to the inner surface of the L-shaped steel frames and each of the steel plates comprise:

a plurality of protrusions formed on the inner surface thereof in such a manner that they are spaced apart from one another and parallel to each other, and one end of each protrusion of said plurality of protrusions is curved; and a plurality of embossed portions formed convexedly between adjacent ones of the protrusions on the inner surface thereof.

2. The built-up rectangular steel column according to claim 1, wherein each of the steel plates is bonded to the inner surface of two of the L-shaped steel frames by means of welding.

3. The built-up rectangular steel column according to claim 2, wherein the thickness of each of the steel plates is between 0.8 mm and 10 mm and each of the protrusions has a height of 35 mm and has a distance of 150 mm from an adjacent protrusion of the protrusions.

* * * * *